US009863184B1

(12) United States Patent
Voss-Andreae

(10) Patent No.: US 9,863,184 B1
(45) Date of Patent: Jan. 9, 2018

(54) WINDOW SECURITY SCREENS

(71) Applicant: Julian Voss-Andreae, Portland, OR (US)

(72) Inventor: Julian Voss-Andreae, Portland, OR (US)

( * ) Notice: Subject to any disclaimer, the term of this patent is extended or adjusted under 35 U.S.C. 154(b) by 0 days.

(21) Appl. No.: 15/359,420

(22) Filed: Nov. 22, 2016

(51) Int. Cl.
*E06B 9/01* (2006.01)
*E06B 3/30* (2006.01)

(52) U.S. Cl.
CPC . *E06B 9/01* (2013.01); *E06B 3/30* (2013.01)

(58) Field of Classification Search
CPC ..... E06B 9/01; E06B 9/00; E06B 2009/02; E06B 9/0623; E06B 2009/524; E06B 9/13
See application file for complete search history.

(56) References Cited

U.S. PATENT DOCUMENTS 6,998,981 B1 * 2/2006 Montague ..... E06B 9/01 160/10
7,313,574 B2 * 12/2007 Paalasmaa ..... G06F 17/30265
8,528,279 B1 * 9/2013 Greene, Jr. ..... E06B 9/01 49/55
2011/0292050 A1 * 12/2011 Gotz ..... G06T 13/00 345/441

OTHER PUBLICATIONS

Kenneth A. Brakke, "The Surface Evolver," Experiemental Mathematics, vol. 1, No. 2, 1992, pp. 141-165.

* cited by examiner

*Primary Examiner* — Beth A Stephan
(74) *Attorney, Agent, or Firm* — Kolisch Hartwell, P.C.

(57) ABSTRACT

Security screens for windows and other openings may include a screen pattern generally conforming to a two-dimensional foam topology, such that solid segments outline a plurality of openings or cells. The solid segments may include circular arcs of varying length and radius, intersecting at 120-degree angles, in threes, at a plurality of vertices. Manufacturing methods may include simulation of a two-dimensional foam subject to certain constraints, such as a target range for the areas of cell openings.

20 Claims, 8 Drawing Sheets

WINDOW SECURITY SCREENS

CROSS-REFERENCES

The following related materials are incorporated herein, in their entireties, for all purposes: "The Surface Evolver" by Kenneth A. Brakke, EXPERIMENTAL MATHEMATICS, Vol. 1 (1992), No. 2, pp. 141-165.

INTRODUCTION

For many years, building and home security has been enhanced by installing bars or grids over windows, doors, and other openings. These solutions enhance security, but tend to detract from the appearance of the building. Not only are the standard bars and grids imposing and unappealing, they also offer limited customization. Furthermore, existing solutions are bulky and often leave large openings between bars. Reduction of the sizes of these openings is costly, in terms of manufacturing cost and material usage. A need exists for attractive, highly variable, relatively low-cost security screens.

SUMMARY

The present teachings address the problems described above by providing an infinitely variable, inexpensive manufacturing method based on two-dimensional foam topologies and a resulting protective security screen that provides security and safety, while avoiding the "prison bars" look and feel of existing solutions.

The present disclosure provides systems, apparatuses, and methods relating to security screens for windows. In some embodiments, A security screen for a window of a building may comprise: a generally planar screen having a plurality of irregular first openings generally conforming to a two-dimensional foam topology, such that each of the first openings is bounded on all sides within the plane of the screen by circular arcs of varying length and radius, ends of the circular arcs joining at 120-degree angles at a plurality of vertices; and a frame extending continuously around the screen and defining a plurality of irregular second openings on a periphery of the screen, the second openings generally conforming to the two-dimensional foam topology, such that each of the second openings is bounded by one or more of the circular arcs and the frame.

In some embodiments, a method for manufacturing a security screen for a window of a building may comprise: generating, using a computer processor, a substantially random seed pattern of Voronoi regions within a plane having a boundary; simulating, using the computer processor, a two-dimensional closed-cell foam topology based on the seed pattern, such that borders between the Voronoi regions are modified to become circular arcs of varying length and radius, intersecting at 120-degree angles at a plurality of vertices to define a plurality of irregular cells; generating, using the computer processor, a final version of the foam topology in which the circular-arc borders have a consistent width; and producing, based on the modified version of the foam topology, a screen structure having a plurality of solid segments delineating a plurality of openings, the solid segments corresponding to the circular-arc borders of the final version of the foam topology and the openings corresponding to the irregular cells of the topology.

Features, functions, and advantages may be achieved independently in various embodiments of the present disclosure, or may be combined in yet other embodiments, further details of which can be seen with reference to the following description and drawings.

DESCRIPTION

Figure 1:
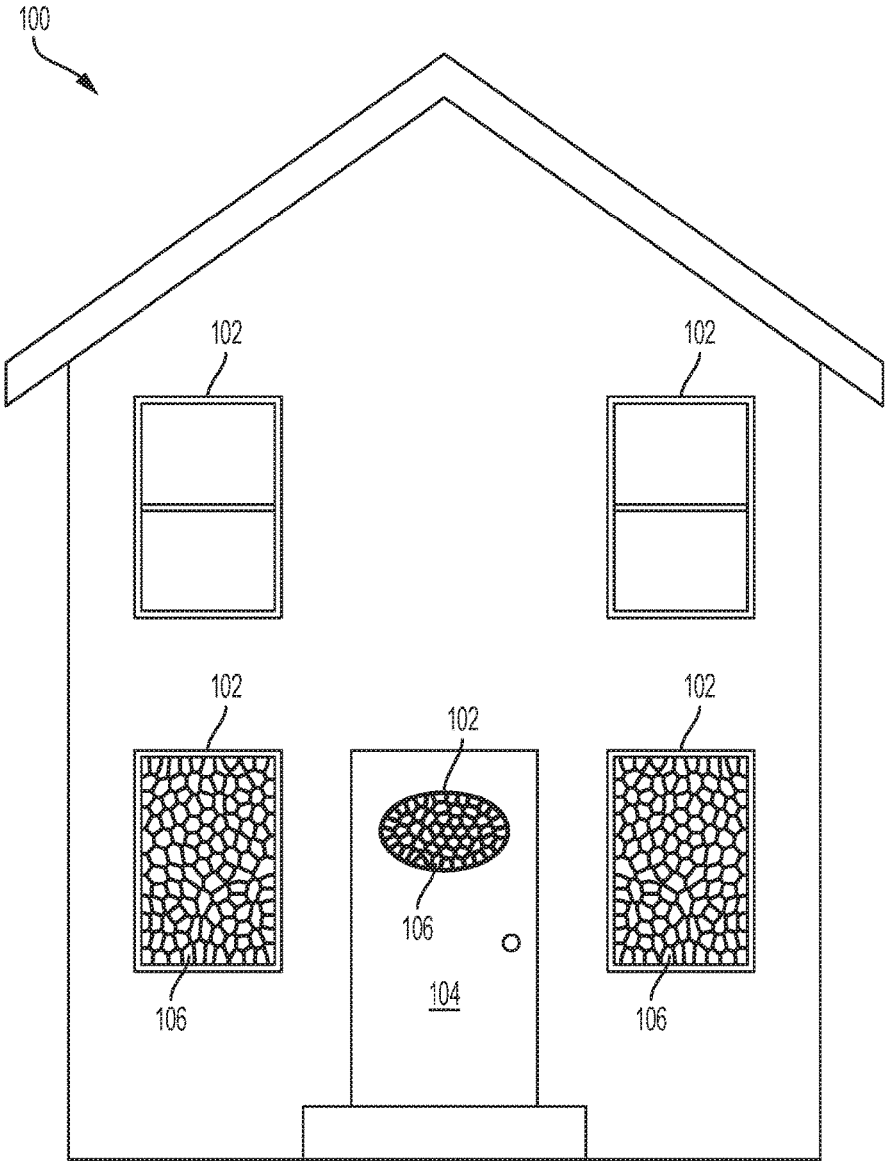
FIG. 1 is a schematic view of an illustrative building incorporating protective screens in accordance with aspects of the present disclosure.

Various aspects and examples of physical security screens for use in protecting the windows of buildings, as well as related methods, are described below and illustrated in the associated drawings. Unless otherwise specified, a security screen according to the present teachings, and/or its various components, may, but are not required to, contain at least one of the structure, components, functionality, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

Definitions

The following definitions apply herein, unless otherwise indicated.

"Substantially" means to be essentially conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

Overview

A liquid-based foam, such as a soap foam, may be contained by a boundary, such that the space within the boundary (e.g., a wire frame or container) is completely filled with bubbles, each of which encloses a volume of gas. The physics of such a system result in a tendency toward surface tension reduction, which causes a minimization of total soap film area and results in the characteristic appearance of such foams. The present disclosure describes devices and systems that incorporate a rigid physical representation of a variable two-dimensional (2D) topology based on such a three-dimensional (3D) foam. In some examples, methods may be described for generating the 2D foam topologies, e.g., through computer simulation, as well as for creating the physical devices based on those topologies. One or more such devices, based on one or more 2D topologies, may be incorporated into a security screen for use on building windows, producing multiple advantages over known security solutions, such as steel bars or grids. Although security screens are described herein in the context of protecting or preventing entry through windows (e.g., on buildings), other suitable applications are also contemplated. For example, screens in accordance with aspects of the present disclosure may comprise protective covers for equipment such as loudspeakers, portions of fences, grilles, strainers, drain covers, and/or the like.

A substantially infinite number of variations of the 2D foam topology can be generated (e.g., based on different initial seed patterns), such that manufacturing of the security screens can be quite flexible. For example, identical copies of a single topology may be produced, and/or variations of a single topology can be created (e.g., by flipping or mirroring), and/or multiple random topologies can be generated as needed. In some examples, constraints may be placed on the foam topologies, to generate security screens meeting desired criteria (e.g., cell sizes and relationships).

A two-dimensional model of a closed-cell foam may be simulated using in any suitable method. For example, aspects of foam pattern generation described herein may be carried out using simulation software, such as the freely-available "Surface Evolver" program by Ken Brakke.

In general, the 2D model or topology described above can be thought of as a cross-section through a 3D foam. Accordingly, the 2D foam surface may inherit certain characteristics associated with 3D foams. For example, as described by Joseph Plateau in the 19th Century, three soap films will always meet along a so-called Plateau border, at 120-degree mutual angles. Also, for example, edges within a foam will have a constant curvature, such that each segment is an arc of a circle. Secure screen systems described herein may include one or more of these characteristics. For example, as described below, a 3D Plateau border may translate into three 2D segments meeting at a vertex, thereby forming three 120-degree angles.

Examples, Components, and Alternatives

The following sections describe selected aspects of exemplary window security screens, as well as related systems and/or methods. The examples in these sections are intended for illustration and should not be interpreted as limiting the entire scope of the present disclosure. Each section may include one or more distinct embodiments or examples, and/or contextual or related information, function, and/or structure.

Illustrative Window Screens

As shown in FIGS. 1-6, this section describes illustrative protective screens for use on building windows. These screens are examples of the screens described in the Overview section above. As mentioned above, screens as described herein may be used for applications other than windows.

Figure 2:
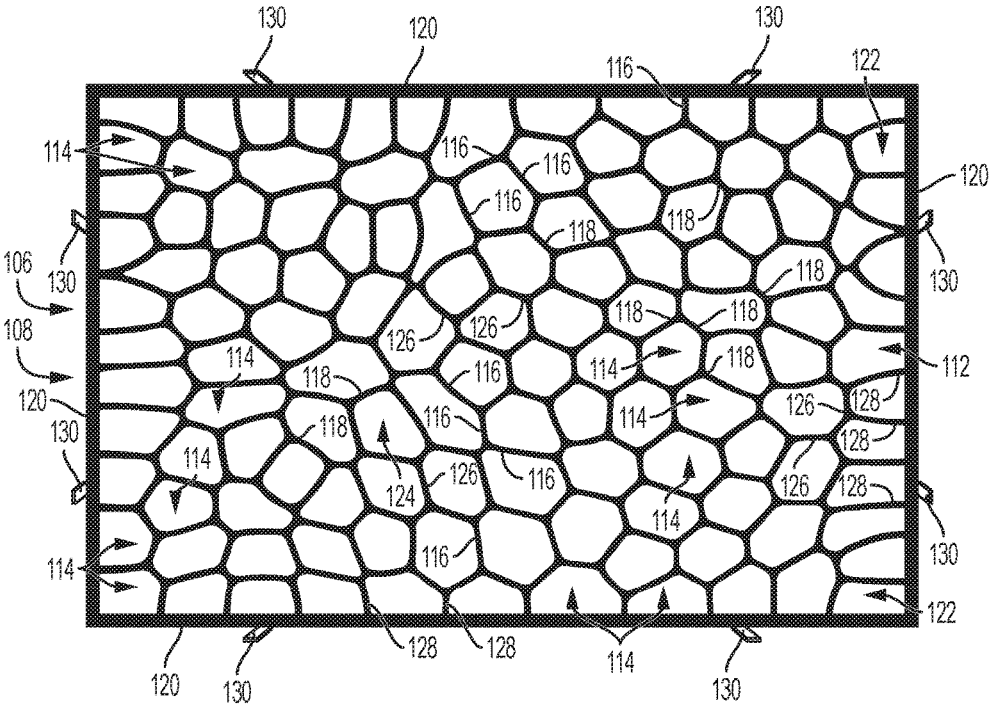
FIG. 2 is a plan view of a rectangular illustrative protective screen based on a foam topology in accordance with aspects of the present disclosure.
Figure 3:
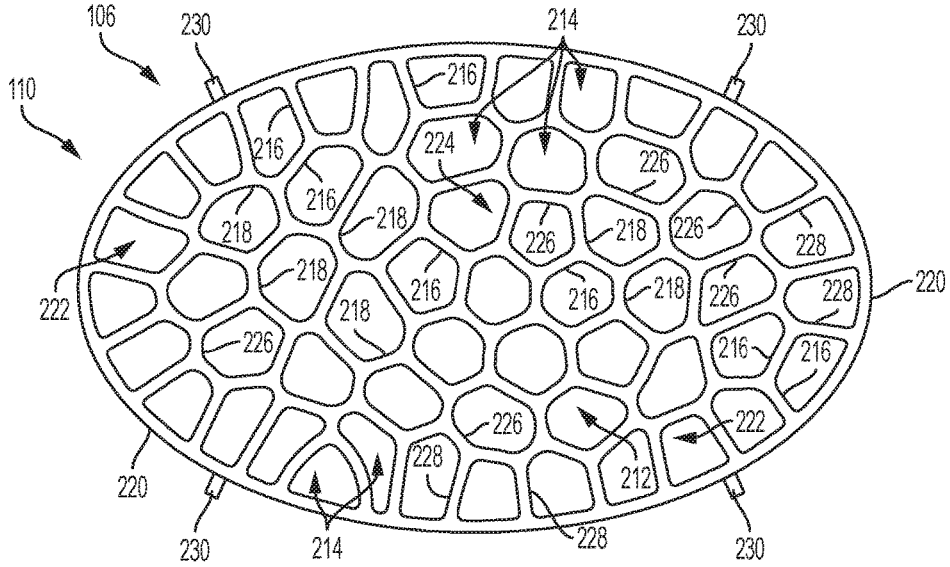
FIG. 3 is a plan view of an elliptical illustrative protective screen based on a foam topology in accordance with aspects of the present disclosure.

FIG. 1 depicts an illustrative building 100 having a plurality of windows 102 and a door 104. A subset of windows 102, in this example the ground floor and door windows, have been covered by security screens 106. As shown in FIG. 1, each window may be covered by a different security screen 106, differentiated by overall shape and/or screen pattern. FIG. 2 depicts a first illustrative screen 108, and FIG. 3 depicts a second illustrative screen 110, both of which are examples of screens 106. Other examples of screens 106 may be produced and used, as described further below. In general, screens 106 may include any suitable, substantially planar pattern of laterally enclosed cells based on a 2D foam topology.

With reference to FIG. 2, screen 108 is a security screen suitable for use with rectangular windows or other openings. Screen 108 includes a pattern 112 having a plurality of closed cells 114 bounded by individual arcuate line segments 116 connected at vertices 118. Closed cells 114 are openings passing transversely through screen 108, each opening being "closed" in a two-dimensional sense. In other words, the cell openings are bounded on all sides with respect to the plane of the screen.

Pattern 112 may include any suitable two-dimensional foam topology comprising the aforementioned plurality of closed cells 114 and bounded on an external perimeter by a frame 120. For example, pattern 112 may include a first (outer or perimeter) portion 122, which includes any segments 116 that intersect frame 120, and a second (inner bulk) portion 124, which includes any segments 116 that only intersect other segments 116.

Segments 116, also referred to as borders or boundaries, may include any suitable length of material having a width (generally smaller than the length), having a shape substantially forming an arc of a circle, and terminating at each end at an intersection with either another segment 116 or with frame 120. Although each segment 116 substantially conforms to an arc of a circle, the respective arc length and the corresponding radius of each arc may vary significantly from segment to segment. Accordingly, some segments 116 may be more curved (i.e., those with relatively small corresponding radii), and some segments 116 may be less curved and/or may appear nearly or approximately linear (i.e., those with large corresponding radii). To facilitate the security-enhancing nature of screen 108, segments 116 may comprise any suitably strong and rigid material, such as a metal or metal alloy (e.g., steel). Other materials may be used, depending on the amount of protection desired.

Segments 116 of inner bulk portion 124 may be configured to intersect at a first end with a first pair of other segments, and at a second end with a second pair of other segments. Accordingly, segments 116 of inner bulk portion 124 only intersect in groups of three, at a single respective vertex 118. Each of the groups of three segments 116 in inner bulk portion 124 will intersect (and terminate) at a respective vertex 118, at an approximately 120-degree local angle with respect to each other. As described above, this 2D arrangement corresponds to the three-dimensional Plateau edge found in 3D foam topologies. As depicted in FIG. 2, the linked arrangement of segments results in and defines closed cells 114. Cells 114 disposed in inner bulk portion 124, generally indicated at 126, will be bounded on all sides by segments 116. Cells 126 may take the form of two-dimensional, closed shapes having two or more curved sides (i.e., segments 116). Cells 126 typically include three or more sides, due to certain manufacturing methods described below. Cells 126, and cells 114 in general, are irregularly sized, such that the cells have a substantially random distribution of shapes and sizes, within certain limits and/or constraints.

Outer portion 122 of pattern 112 includes a single layer of cells 114, generally indicated at 128 in FIG. 2. Cells 114 are defined and bounded by segments 116, which intersect at one end (at a vertex 118) with a pair of other segments 116 and at the other end with frame 120. Frame 120 is rectangular, to conform to an expected rectangular window or opening. Accordingly, the sides of frame 120 are linear, such that cells 128 are each bounded by one or two straight sides (i.e., frame 120) and at least two curved sides (i.e., segments 116).

As is the case with all vertices 118 in this example, the vertex end of each segment in outer portion 122 meets each of its vertex neighbors at a 120-degree angle. In contrast, the frame end of each segment in outer portion 122 meets frame 120 at a substantially right angle (i.e., approximately 90 degrees). This 2D arrangement corresponds to the three-dimensional topology found in 3D foams free to move along an edge or container wall. In such topologies, soap bubbles will cling to the surface with films extending at substantially right angles from the surface. Other than the 90-degree angles formed with frame 120, segments 116 in outer portion 122 have substantially identical features to those in the inner bulk portion.

Frame 120 may include any suitable perimeter structure configured to laterally enclose cells 114 and provide a boundary conforming generally to the shape of an underlying window or opening, as well as providing a mounting mechanism for the screen. In some examples, frame 120 may be unitary or monolithic with segments 116 in pattern 112. In some examples, frame 120 may be fixed to the outer segments of pattern 112, such as by welding. In some examples, frame 120 may be reinforced. As shown in FIG. 2, frame 120 is a continuous rectangular frame having a width larger than that of segments 116. A plurality of mounting tabs 130 extend from frame 120 for securely attaching screen 108 to a support structure (e.g., a wall, a window sill or jamb, a door, etc.). For example, mounting hardware, such as bolts, screws, and the like, may be used to fix tabs 130 to a wall, thereby coupling frame 120, and therefore screen 108, to a structure.

Turning to FIG. 3, screen 110 is a second example of screens 106, and is a security screen suitable for use with oval windows or other oval openings. Similar to screen 108, screen 110 includes a pattern 212 of closed cells 214 bounded by individual arcuate line segments 216 connected at vertices 218. As with cells 114, closed cells 214 are openings passing transversely through screen 110, each opening being "closed" in a two-dimensional sense. In other words, the cell openings are bounded on all sides with respect to the plane of the screen.

Pattern 212 may include any suitable two-dimensional foam topology comprising the aforementioned plurality of closed cells 214 and bounded on an external perimeter by a frame 220. For example, pattern 212 may include a first (outer or perimeter) portion 222, which includes any segments 216 that intersect frame 220, and a second (inner bulk) portion 224, which includes any segments 216 that only intersect other segments 216.

Segments 216 may include any suitable length of material having a width (generally smaller than the length), having a shape substantially forming an arc of a circle, and terminating at each end at an intersection with either another segment 216 or with frame 220. Although each segment 216 substantially conforms to an arc of a circle, the respective arc length and the corresponding radius of each arc may vary significantly from segment to segment. Accordingly, as described with respect to segments 116, some segments 216 may be more curved (i.e., those with relatively small corresponding radii), and some segments 216 may be less curved or even appear nearly linear (i.e., those with large corresponding radii). Segments 216 may comprise any suitably strong and rigid material, such as a metal or metal alloy (e.g., steel). Other materials may be used, depending on the amount of protection desired.

Segments 216 of inner bulk portion 224 may be configured to intersect at a first end with a first pair of other segments, and at a second end with a second pair of other segments. Accordingly, segments 216 of inner bulk portion 224 only intersect in groups of three, at a single respective vertex 218. Each of the groups of three segments 216 in inner bulk portion 224 will intersect and terminate at a respective vertex 218, at approximately 120-degree angles with respect to each other. As described above, this 2D arrangement corresponds to the three-dimensional Plateau edge found in 3D foam topologies. As depicted in FIG. 3, the linked arrangement of segments results in and defines closed cells 214. Cells 214 disposed in inner bulk portion 224, generally indicated at 226, will be bounded on all sides by segments 216. Cells 226 may take the form of two-dimensional, closed shapes having two or more curved sides (i.e., segments 216). Cells 226 typically include three or more sides, due to certain manufacturing methods described below. Cells 226, and cells 214 in general, are irregularly sized, such that the cells have a substantially random distribution of shapes and sizes, within certain limits and/or constraints.

Outer portion 222 of pattern 212 includes a single layer of cells 214, generally indicated at 228 in FIG. 3. Cells 214 are defined and bounded by segments 216, which intersect at one end (at a vertex 218) with a pair of other segments 216, and at the other end with frame 220. Frame 220 is elliptical (e.g., oval), to conform to an expected oval window or opening. Accordingly, the sides of frame 220 are curvilinear, such that cells 228 are each bounded by one elliptically-curved side, oriented concave-inward (i.e., frame 220) and at least two circular-arc-curved sides (i.e., segments 216). In some examples, frame 220 may be circular or polygonal, or any other suitable shape configured to provide a secure cover for a window or opening.

As with screen 108, the frame end of each segment in outer portion 222 of screen 110 meets elliptical frame 220 locally at a substantially right angle (i.e., approximately 90 degrees). This 2D arrangement again corresponds to the three-dimensional topology found in 3D foams clinging to an edge or container wall, as described above. Other than the 90-degree angles formed with frame 220, segments 216 in outer portion 222 have substantially identical features to those in the inner bulk portion.

Frame 220 may include any suitable perimeter structure configured to laterally enclose cells 214 and provide a boundary conforming generally to the shape of an underlying window or opening, as well as providing a mounting mechanism for the screen. In some examples, frame 220 may be unitary or monolithic with segments 216 in pattern 212. In some examples, frame 220 may be fixed to the outer segments of pattern 212, such as by welding. In some examples, frame 220 may be reinforced. As shown in FIG. 3, frame 220 is a continuous elliptical frame having a width substantially identical to that of segments 216. A plurality of mounting tabs 230 extend from frame 220 for securely attaching screen 110 to a support structure (e.g., a wall or window frame).

Figure 4:
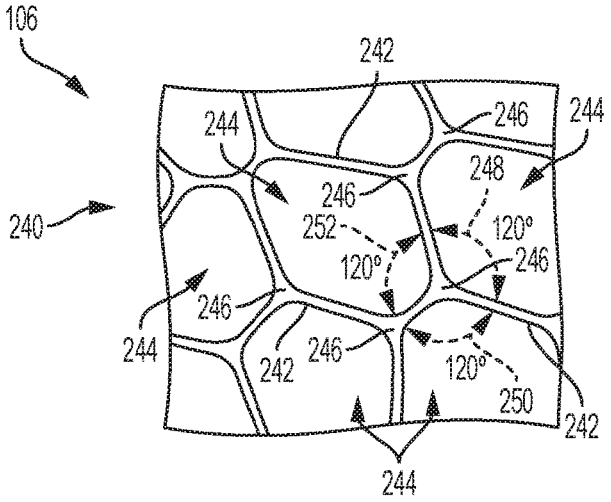
FIG. 4 is a magnified view of an inner portion of an illustrative protective screen.
Figure 5:
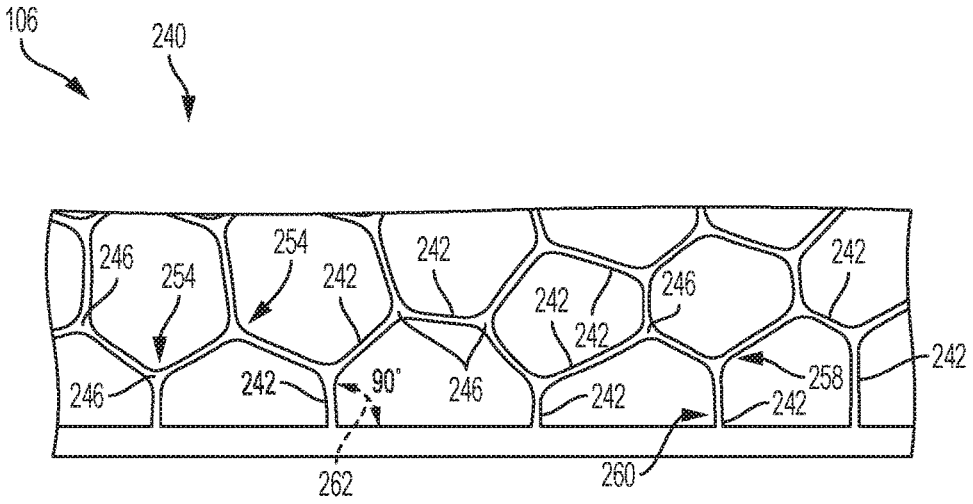
FIG. 5 is a magnified view of an outer portion of an illustrative protective screen.

FIGS. 4 and 5 are each detailed views of respective portions of an illustrative screen 240. Screen 240 is an example of screens 106. As described above with respect to screens 108 and 110, screen 240 includes a pattern of segments 242 which define openings or cells 244 and intersect in groups of three at respective vertices 246. As shown in FIG. 4, the angles between converging segments at any given vertex 246, such as angle 248, angle 250, and angle 252, are each approximately or exactly 120 degrees. As depicted in FIG. 4 and elsewhere, interior corners of each vertex 246 may be radiused (e.g., rounded) in the plane of the screen, as indicated at 254. FIG. 5 shows a perimeter portion of screen 240, where segments 242 intersect with a frame 256 of the screen. As described above, each frame-intersecting segment forms a 120-degree angle with other segments at a first end 258 and a substantially right (90-degree) angle with frame 256 at a second end 260. For example, as depicted in FIG. 5, angle 262 is approximately 90 degrees.

Figure 6:
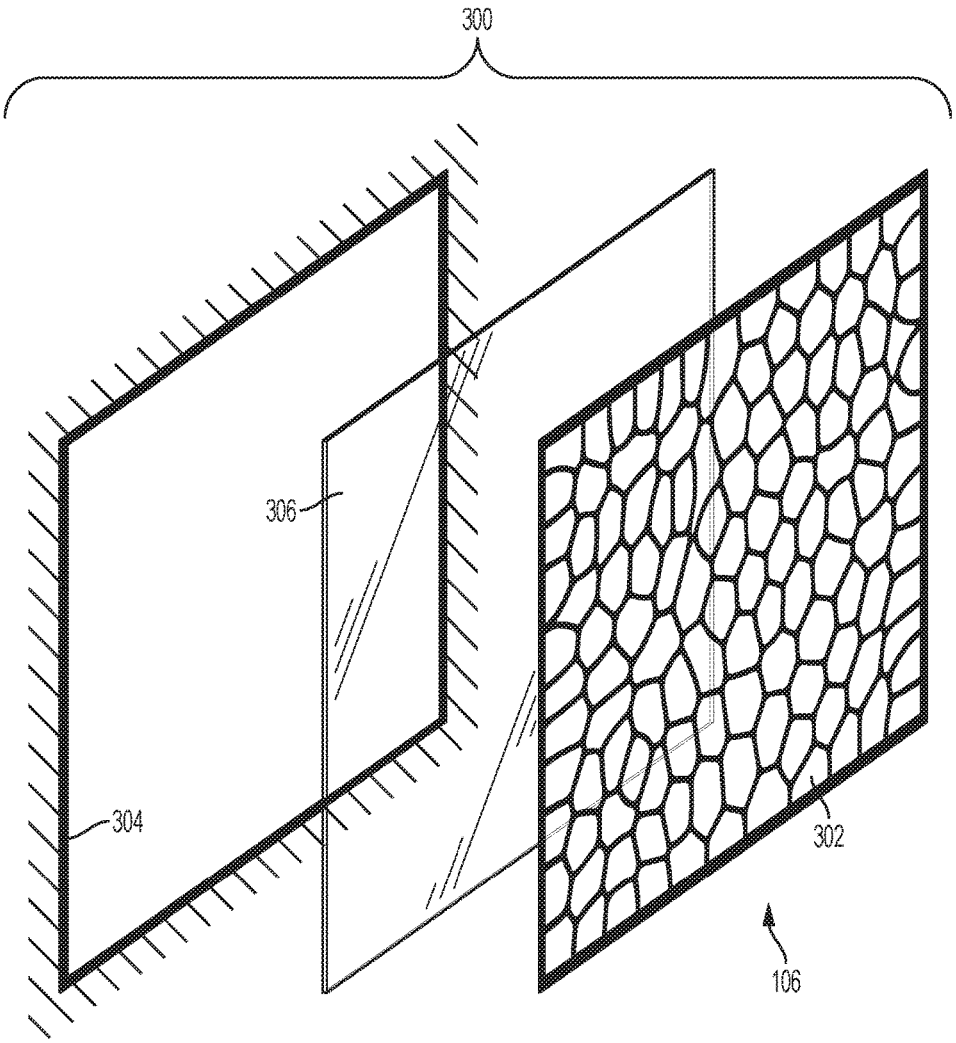
FIG. 6 is an exploded view of an illustrative window assembly incorporating a protective screen according to the present teachings.

Turning to FIG. 6, an illustrative screen and window assembly 300 is shown in exploded view. A screen 302, which is an example of screens 106 (e.g., screen 108 or 110), is attachable to a window perimeter 304, such that a window 306 (e.g., one or more panes of glass) is covered and protected by screen 302. Note that screen 302 may be attached to an inner or an outer surface. In other words, window perimeter 304 may comprise an inner or an outer surface of the building. If attached outside the window, screen 302 may provide additional security, by resisting or preventing access to the window glass itself. In either case, screen 302 may facilitate denial of entry into the building.

Based on the above description, some embodiments of a security screen 106 may comprise a screen portion including a plurality of coplanar first segments (e.g., segments 116, 216, 242), each of the first segments having opposing ends and generally forming an arc of a respective circle, each end of each of the first segments terminating at a respective vertex (e.g., vertices 118, 218, 246), each vertex joining two or more of the first segments at 120-degree angles (e.g., angles 248, 250, 252). An outer frame portion (e.g., frame 120, 220, 256) may extend continuously around a periphery of the screen portion, the frame portion and the screen portion generally defining a plane of the screen. A plurality of second segments may connect the frame portion to the screen portion, each of the second segments having a first end connected directly to the frame at a 90-degree angle (e.g., end 260) and a second end connected at a 120-degree angle to a respective two of the first segments at a vertex (e.g., end 262). Accordingly, the first segments, the second segments, and the frame may circumscribe a plurality of irregularly-shaped openings (e.g., cells 114, 214, 244) through the screen portion, such that each of the openings is enclosed on all sides within the plane of the screen.

Based on the above description, some embodiments of a security screen 106 may comprise a screen portion defining a plane and including a plurality of coplanar arc segments (e.g., segments 116, 216, 242) joined at respective vertices (e.g., vertices 118, 218, 246), such that a respective three of the arc segments extend at 120-degree angles from each vertex. A frame portion (e.g., frames 120, 220, 256) may extend continuously around a periphery of the screen portion, the frame portion connected to the screen portion by a subset of the arc segments, each one of the subset of arc segments having a first end connected to a respective vertex and a second end directly connected to the frame portion at a 90-degree angle. The plurality of arc segments includes a plurality of arc lengths and corresponding radius lengths, such that the arc segments and the frame portion define a plurality of irregular openings through the screen (e.g., cells 114, 214, 244), each opening being enclosed on all sides within the plane of the screen.

Based on the above description, some embodiments of security screen 106 may comprise a generally planar screen having a plurality of irregular first openings (e.g., openings 124) generally conforming to a two-dimensional foam topology, such that each of the first openings is bounded on all sides within the plane of the screen by circular arcs of varying length and radius, ends of the circular arcs joining at 120-degree angles at a plurality of vertices. A frame (e.g., frames 120, 220, 256) may extend continuously around the screen and define a plurality of irregular second openings (e.g., openings 122) on a periphery of the screen, the second openings generally conforming to the two-dimensional foam topology, such that each of the second openings is bounded by one or more of the circular arcs and the frame.

The openings (e.g., openings 124) of security screen 106 may be generally sized to conform with an intended use of the screen. For example, if a goal of the screen is to prevent passage of a human body, a maximum opening size may be established at approximately thirty square inches. In another example, if a goal of the screen is to prevent passage of a human head, the maximum opening size may be established at fifteen square inches. In another example, if a goal of the screen is to prevent passage of a human hand, the maximum opening size may be established at four square inches. Other maximum sizes may be suitable.

Illustrative Manufacturing Method

This section describes steps of an illustrative method for manufacturing window security screens according to the present teachings; see FIGS. 7-15. Aspects of security screens 106 (e.g., screens 108, 110, 240) may be utilized and/or included in the method steps described below. Where appropriate, reference may be made to components and systems that may be used in carrying out each step. These references are for illustration, and are not intended to limit the possible ways of carrying out any particular step of the method.

Aspects of window security screen manufacturing methods may be embodied and/or implemented as a computer method, computer system, or computer program product. Accordingly, aspects of the window security screen manufacturing methods may take the form of an entirely hardware embodiment, an entirely software embodiment (including firmware, resident software, micro-code, and the like), or an embodiment combining software and hardware aspects, all of which may generally be referred to herein as a "circuit," "module," or "system." Furthermore, aspects of the window security screen manufacturing methods may take the form of a computer program product embodied in a computer-readable medium (or media) having computer-readable program code/instructions embodied thereon.

Any combination of computer-readable media may be utilized. Computer-readable media can be a computer-readable signal medium and/or a computer-readable storage medium. A computer-readable storage medium may include an electronic, magnetic, optical, electromagnetic, infrared, and/or semiconductor system, apparatus, or device, or any suitable combination of these. More specific examples of a computer-readable storage medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, and/or any suitable combination of these and/or the like. In the context of this disclosure, a computer-readable storage medium may include any suitable tangible medium that can contain or store a program for use by or in connection with an instruction execution system, apparatus, or device.

A computer-readable signal medium may include a propagated data signal with computer-readable program code embodied therein, for example, in baseband or as part of a carrier wave. Such a propagated signal may take any of a variety of forms, including, but not limited to, electromagnetic, optical, and/or any suitable combination thereof. A computer-readable signal medium may include any computer-readable medium that is not a computer-readable storage medium and that is capable of communicating, propagating, or transporting a program for use by or in connection with an instruction execution system, apparatus, or device.

Program code embodied on a computer-readable medium may be transmitted using any appropriate medium, including but not limited to wireless, wireline, optical fiber cable, RF, and/or the like, and/or any suitable combination of these.

Computer program code for carrying out operations for aspects of the window security screen manufacturing methods may be written in one or any combination of programming languages, including an object-oriented programming language such as Java, Smalltalk, C++, and/or the like, and conventional procedural programming languages, such as C. Mobile apps may be developed using any suitable language, including those previously mentioned, as well as Objective-C, Swift, C#, HTML5, and the like. The program code may execute entirely on a user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), and/or the connection may be made to an external computer (for example, through the Internet using an Internet Service Provider).

Aspects of the window security screen manufacturing methods are described below with reference to a flowchart illustration of methods, apparatuses, systems, and/or computer program products. A block and/or combination of blocks in a flowchart may be implemented by computer program instructions. The computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart.

These computer program instructions can also be stored in a computer-readable medium that can direct a computer, other programmable data processing apparatus, and/or other device to function in a particular manner, such that the instructions stored in the computer-readable medium produce an article of manufacture including instructions which implement the function/act specified in the flowchart and/or block diagram block or blocks.

The computer program instructions can also be loaded onto a computer, other programmable data processing apparatus, and/or other device to cause a series of operational steps to be performed on the device to produce a computer-implemented process such that the instructions which execute on the computer or other programmable apparatus provide processes for implementing the functions/acts specified in the flowchart.

Figure 7:
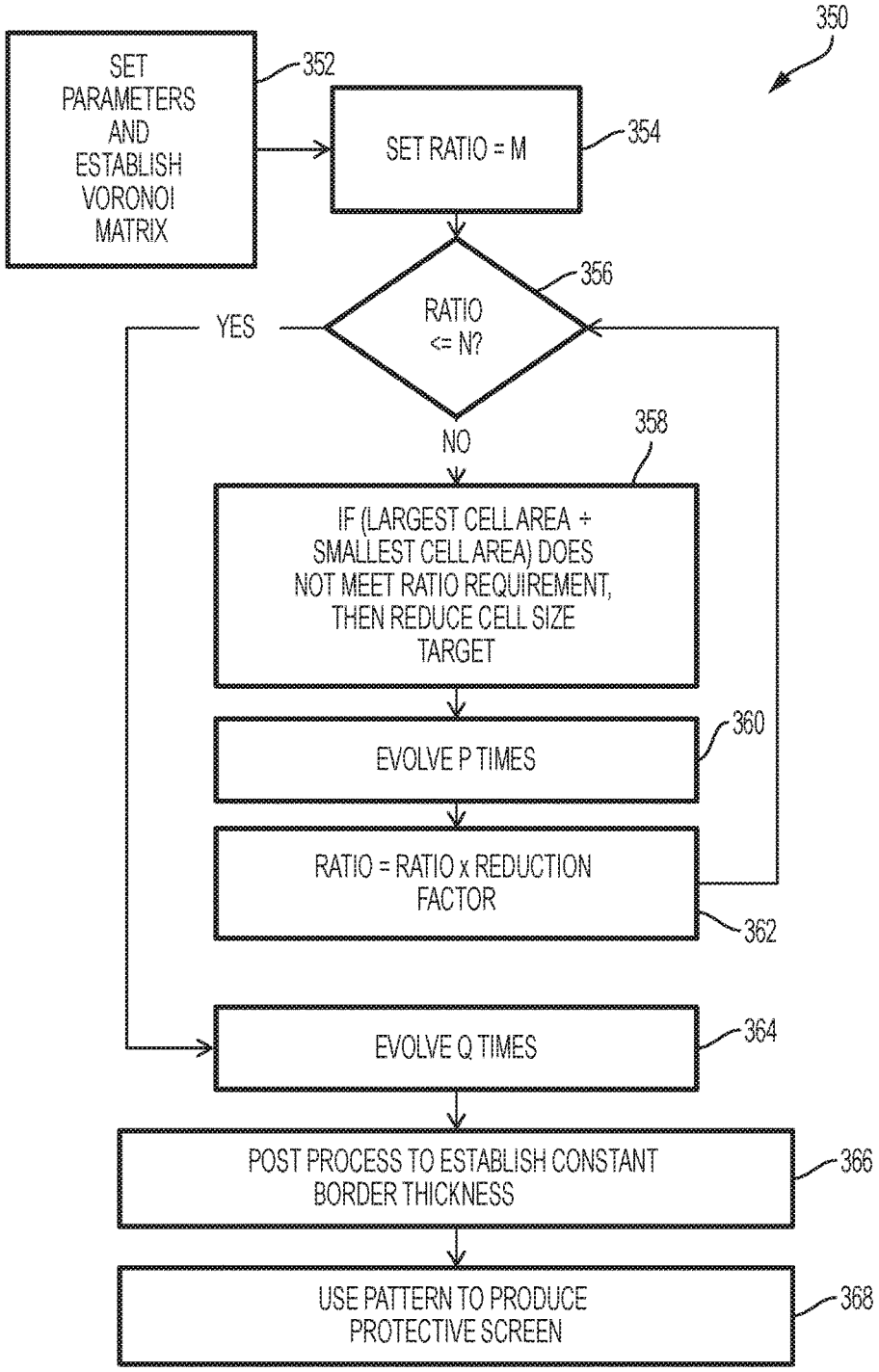
FIG. 7 is a flow chart of an illustrative method for manufacturing a protective screen in accordance with aspects of the present disclosure.

The flowchart in FIG. 7 is intended to illustrate the architecture, functionality, and/or operation of possible implementations of systems, methods, and computer program products according to aspects of the manufacturing method. In this regard, each block may represent a module, segment, or portion of code, which comprises one or more executable instructions for implementing the specified logical function(s). In some implementations, the functions noted in the block may occur out of the order noted in the drawings. For example, two blocks shown in succession may, in fact, be executed substantially concurrently, or the blocks may sometimes be executed in the reverse order, depending upon the functionality involved. Each block and/or combination of blocks may be implemented by special purpose hardware-based systems (or combinations of special purpose hardware and computer instructions) that perform the specified functions or acts.

FIG. 7 is a flowchart illustrating steps performed in an illustrative method, and may not recite the complete process or all steps of the method. FIG. 7 depicts multiple steps of a manufacturing method, generally indicated at 350. Although various steps of method 350 are described below and depicted in FIG. 7, the steps need not necessarily all be performed, and in some cases may be performed in a different order than the order shown. Illustrative examples corresponding to one or more steps of method 350 are provided in FIGS. 8-15.

In general, method 350 begins with an initial seed pattern that partitions a planar area into polygonal regions. The initial pattern of polygons is evolved algorithmically to simulate a foam topology having a plurality of cells as described above. Certain constraints (e.g., cell size limitations) are also satisfied by the algorithm. One or more steps of method 350 may include the use of a foam simulation program. For illustration, the freely-available "Surface Evolver" program (by Ken Brakke) is described and referenced for this purpose in method 350. However, any suitable foam simulation program capable of carrying out the applicable steps below may be used.

Figure 8:
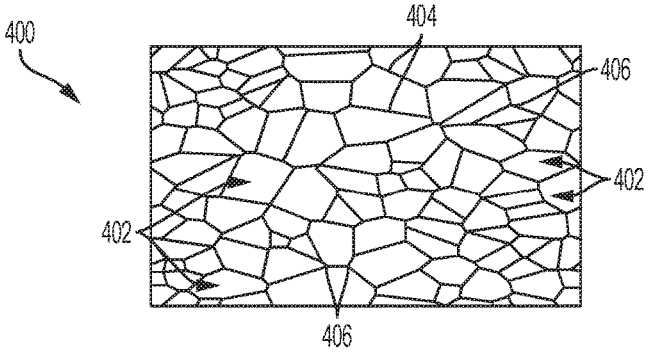
FIG. 8 is an illustrative seed pattern suitable for use in a manufacturing method according to the present teachings.
Figure 9:
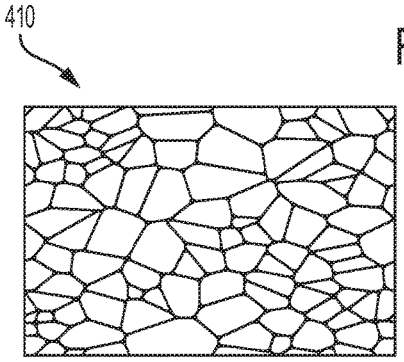
FIG. 9 is a first illustrative intermediate pattern as the seed pattern of FIG. 8 is evolved by the manufacturing simulation process in the presence of selected constraints.
Figure 10:
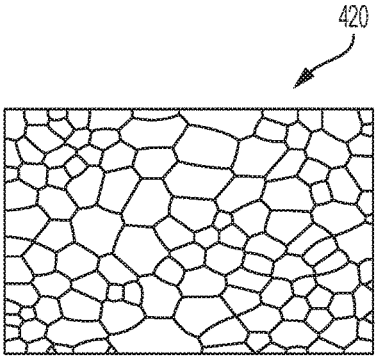
FIG. 10 is a second illustrative intermediate pattern as the intermediate pattern of FIG. 9 is evolved by the manufacturing simulation process in the presence of selected constraints.
Figure 11:
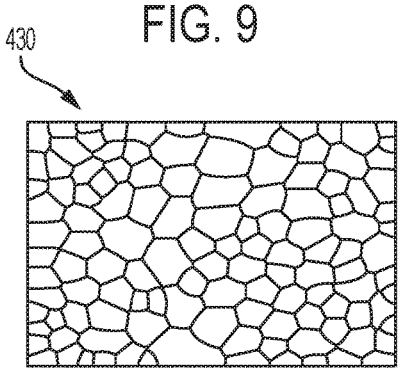
FIG. 11 is a third illustrative intermediate pattern as the intermediate pattern of FIG. 10 is evolved by the manufacturing simulation process in the presence of selected constraints.
Figure 12:
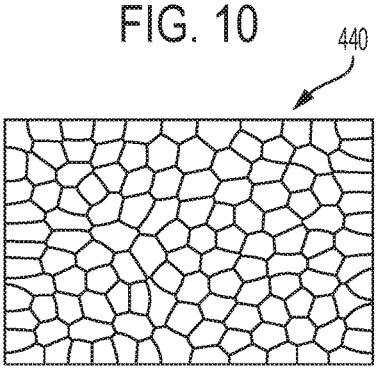
FIG. 12 is a fourth illustrative intermediate pattern as the intermediate pattern of FIG. 11 is evolved by the manufacturing simulation process in the presence of selected constraints.

Accordingly, at step 352 of method 350, a user sets up the program parameters and establishes an initial matrix of Voronoi cells, also referred to as a Voronoi diagram or a Voronoi tessellation. In general, a Voronoi diagram is a planar area that has been partitioned by generating a number of seed points in the plane (e.g., randomly) and then dividing the area into regions or cells, each region being the set of all points that are closer to a respective one of the seed points. Consequently, these regions will be convex polygons, the sides of which are line segments made up of points that are equidistant to the two nearest seed points. The vertices of the polygonal regions are each equidistant to three or more seed points. An illustrative Voronoi diagram 400 is shown in FIG. 8, with regions 402, border segments 404, and vertices 406. The overall area may be any suitable shape, such as a rectangle or ellipse, and is chosen at this step 352 to correspond to the desired overall shape of the screen to be produced.

The number of Voronoi seed points, and therefore the number of initial regions, may be selected based on a desired number of final cells in the screen. For example, a user may want an average hole size (i.e., cell area) to be less than a certain threshold, such that a human hand would be unlikely to fit through the resulting openings. Accordingly, the number of Voronoi regions may be selected, such that the overall area will be divided into openings smaller (on average) than that threshold. Other parameters may be selected at this step 352.

Figure 14:
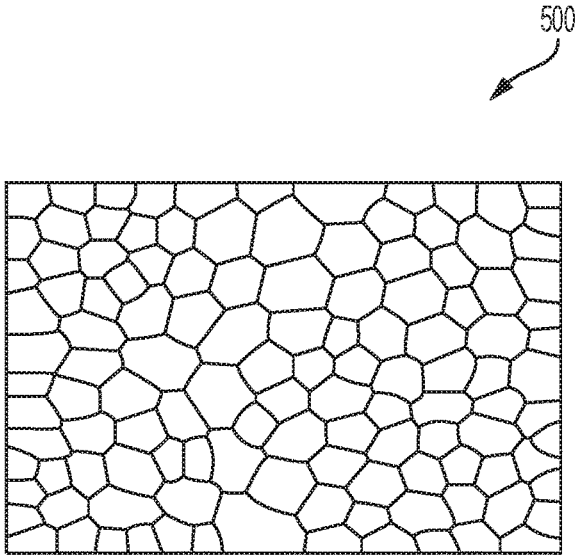
FIG. 14 is another illustrative foam topology pattern having a first cell area ratio.
Figure 15:
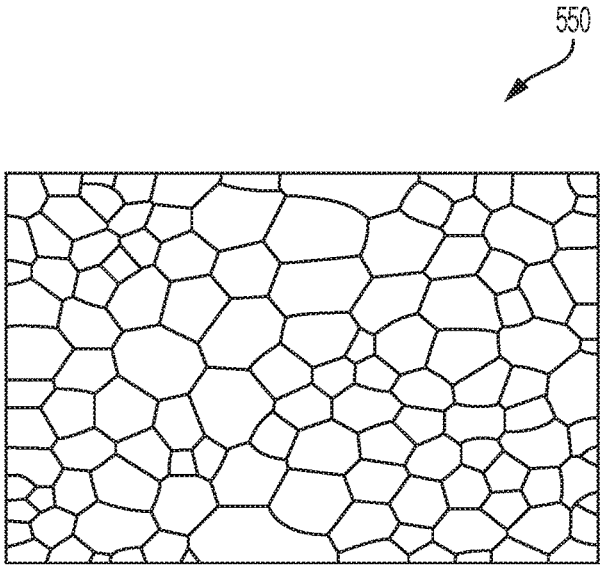
FIG. 15 is another illustrative foam topology pattern having a second cell area ratio, higher than the ratio of FIG. 14.

The range of cell sizes in a pattern generated by method 350 may be determined by selecting a target ratio of largest cell area to smallest cell area. Although the regions of the initial Voronoi tessellation may be unlikely to satisfy this ratio, other steps of method 350 will steer (e.g., evolve) the pattern toward compliance. FIGS. 14 and 15 depict two examples of final foam topology patterns generated by method 350, based on two different cell size ratios. A first pattern 500 is shown in FIG. 14. Pattern 500 was generated using a cell size ratio of 5:1. In other words, the largest cell in pattern 500 is no more than approximately five times larger than the smallest cell, in terms of area. A second pattern 550 is shown in FIG. 15. Pattern 550 was generated using a cell size ratio of 30:1. In other words, the largest cell in pattern 550 is no more than approximately thirty times larger than the smallest cell, in terms of area. In the example of method 350 described below, an illustrative cell size ratio of 2:1 is selected.

Accordingly, at step 354, a variable designated "RATIO" is set to a selected initial cell size ratio (M), and at step 356, the current value of RATIO is compared to a final desired (i.e., target) cell size ratio (N). In general, M is set to be larger than N, such that the loop comprising steps 356 through 362 is carried out at least once. For example, M may be set to 100 and N set to 2. If step 356 determines that the variable RATIO is larger than the target of N (e.g., 2), then execution passes to step 358.

At step 358, the actual ratio of largest cell area to smallest cell area is determined and compared to the current value of RATIO. If the actual ratio fails to meet the current maximum ratio, meaning the largest cell and smallest cell are too different from each other, then the target cell size for the simulation is reduced. At step 358, if the actual ratio satisfies the current value of RATIO, then the target cell size remains unchanged.

At step 360, the evolution of the pattern is run for a selected number of iterations (P). The Surface Evolver program evolves a pattern iteratively, with the goal of minimizing surface tension, i.e., minimizing overall edge length. Any suitable number of iterations may be selected, such as P=100. This operation will cause the pattern to become more in line with the 2D foam topology and/or will urge the pattern's cell size ratio more into compliance with the current value of RATIO.

At step 362, the value of RATIO is changed by a reduction factor, e.g., by multiplying the value of RATIO by a number less than 1.0. For example, a reduction factor of 0.95 may be utilized. This step will be repeatedly executed as the algorithm loops through steps 356-362, causing the value of RATIO to approach the target ratio (e.g., 2.0) in an exponential fashion (i.e., through exponential decay). This has been found to help "ease" the pattern iteratively into compliance.

At step 356, the algorithm again checks the now-reduced value of RATIO against the target of N. If RATIO remains above N, the loop will repeat, each time causing RATIO to come closer to N, until RATIO is finally less than or equal to N. At this point, the actual cell ratio should be substantially close to N. Execution passes to step 364, where the pattern is again evolved by the Surface Evolver program through a selected number of iterations (Q). Any suitable number of iterations may be selected, such as Q=2,000. The result of step 364 will be a final foam topology substantially compliant with the target cell size ratio (N) and having the characteristics of a foam topology, such as 120-degree vertices in the inner bulk, circular-arc segments, and 90-degree intersections with the frame.

Figure 13:
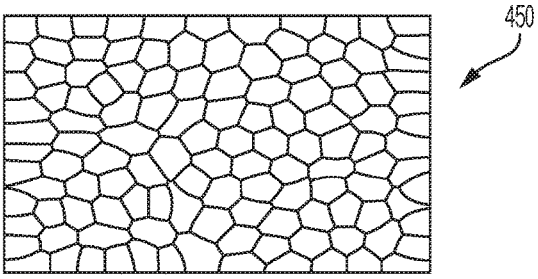
FIG. 13 is an illustrative final foam topology pattern produced by evolving the seed pattern of FIG. 8 through the intermediate patterns of FIGS. 9-12.

FIGS. 8-13 are illustrative examples of various stages of evolution of the pattern. As described above, FIG. 8 is the initial Voronoi tessellation pattern 400. FIGS. 9-12 are intermediate forms of the pattern, indicated at 410, 420, 430, and 440, as it is changed over time by the algorithm. FIG. 13 is a final version of the pattern, indicated at 450.

At step 366, post processing is performed on the pattern resulting from step 364 (e.g., pattern 450), to generate a final version of the pattern suitable for physical manufacturing. For example, the borders between cells and/or the vertices where the borders meet may be thickened to ensure consistent or constant line thickness, radiused corners, and/or the like, or any combination of these. When thickening the borders, it may be thought of in the sense that the modelling happens in two steps: a "dry foam" is first simulated, with negligibly thin Plateau borders; then "liquid" is added in a second step to thicken those borders.

At step 368, the final pattern produced in step 366 is used to generate a physical structure, i.e., the screen. For example, a metal (e.g., steel) plate may be cut (e.g., laser cut) or machined to match the pattern. In some examples, the final pattern may be loaded into a 3D printer or similar device and produced by additive manufacturing, using any suitable material. In some examples, the final pattern may be used as a template, and segments of material may be laid down and connected to each other, such as by welding, brazing, soldering, etc.

Based on the above description, the manufacture of a security screen in accordance with the present teachings may include generating, using a computer processor, a substantially random seed pattern of Voronoi regions within a plane having a boundary. Using the computer processor, a two-dimensional closed-cell foam topology may be simulated based on the seed pattern, such that borders between the Voronoi regions are modified to become circular arcs of varying length and radius, intersecting at 120-degree angles at a plurality of vertices to define a plurality of irregular cells. A final version of the foam topology may then be generated, in which the circular-arc borders have a consistent width. A screen structure may then be produced, based on the final version of the foam topology. The screen structure may have a plurality of solid segments delineating a plurality of openings, the solid segments corresponding to the circular-arc borders of the modified foam topology and the openings corresponding to the irregular cells of the topology. In some examples, the screen further includes a continuous frame disposed at the boundary of the plane of the topology. For example, the boundary and the frame may be rectangular, elliptical, or polygonal.

In some examples, simulating the foam topology further includes modifying the borders between peripheral Voronoi regions to intersect the boundary of the plane at respective 90-degree angles. In some examples, simulating the foam topology further includes limiting a range of sizes of the irregular cells. For example, a target ratio (e.g., 2.0) of an area of a largest one of the cells to an area of a smallest one of the cells may be selected. In some examples, the screen structure is attached to a building after its manufacture is complete.

In some examples, the initial Voronoi tessellation may be modified such that the Voronoi cells are encouraged to be of a similar size. This modification may eliminate or reduce the need for the size ratio constraint and related steps.

Illustrative Data Processing System

Figure 16:
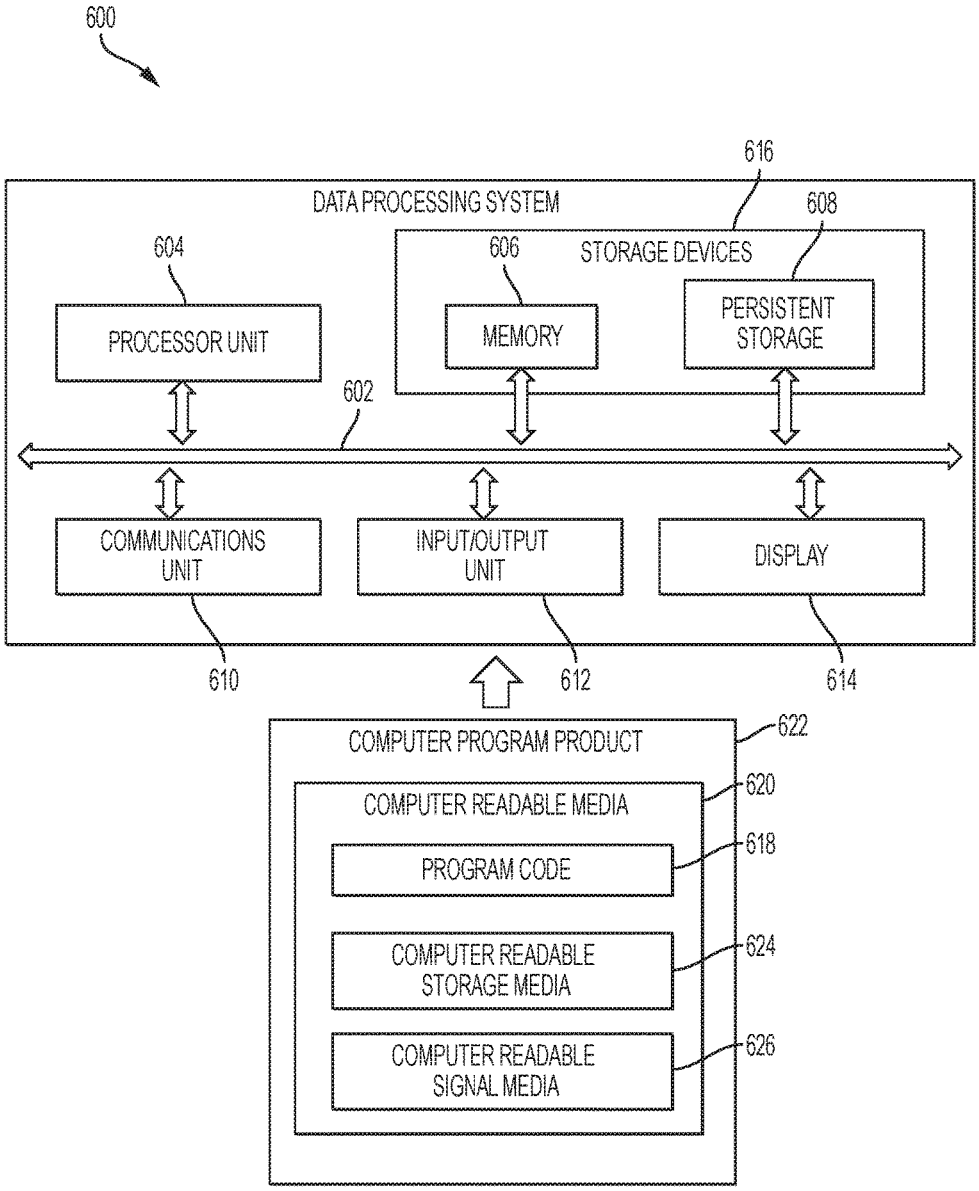
FIG. 16 is a schematic diagram of an illustrative data processing system suitable for use in aspects of the present disclosure.

As shown in FIG. 16, this example describes a data processing system 600 (also referred to as a computer) in accordance with aspects of the present disclosure. In this example, data processing system 600 is an illustrative data processing system suitable for implementing aspects of manufacturing methods such as method 350. More specifically, in some examples, devices that are embodiments of data processing systems (e.g., smartphones, tablets, personal computers) may be utilized to run algorithmic steps of method 350 (or another suitable manufacturing method). For example, a data processing system may run the Surface Evolver program, and/or may execute steps of method 350.

In this illustrative example, data processing system 600 includes communications framework 602. Communications framework 602 provides communications between processor unit 604, memory 606, persistent storage 608, communications unit 610, input/output (I/O) unit 612, and display 614. Memory 606, persistent storage 608, communications unit 610, input/output (I/O) unit 612, and display 614 are examples of resources accessible by processor unit 604 via communications framework 602.

Processor unit 604 serves to run instructions that may be loaded into memory 606. Processor unit 604 may be a number of processors, a multi-processor core, or some other type of processor, depending on the particular implementation. Further, processor unit 604 may be implemented using a number of heterogeneous processor systems in which a main processor is present with secondary processors on a single chip. As another illustrative example, processor unit 604 may be a symmetric multi-processor system containing multiple processors of the same type.

Memory 606 and persistent storage 608 are examples of storage devices 616. A storage device is any piece of hardware that is capable of storing information, such as, for example, without limitation, data, program code in functional form, and other suitable information either on a temporary basis or a permanent basis.

Storage devices 616 also may be referred to as computer-readable storage devices in these examples. Memory 606, in these examples, may be, for example, a random access memory or any other suitable volatile or non-volatile storage device. Persistent storage 608 may take various forms, depending on the particular implementation.

For example, persistent storage 608 may contain one or more components or devices. For example, persistent storage 608 may be a hard drive, a flash memory, a rewritable optical disk, a rewritable magnetic tape, or some combination of the above. The media used by persistent storage 608 also may be removable. For example, a removable hard drive may be used for persistent storage 608.

Communications unit 610, in these examples, provides for communications with other data processing systems or devices. In these examples, communications unit 610 is a network interface card. Communications unit 610 may provide communications through the use of either or both physical and wireless communications links.

Input/output (I/O) unit 612 allows for input and output of data with other devices that may be connected to data processing system 600. For example, input/output (I/O) unit 612 may provide a connection for user input through a keyboard, a mouse, and/or some other suitable input device. Further, input/output (I/O) unit 612 may send output to a printer. Display 614 provides a mechanism to display information to a user.

Instructions for the operating system, applications, and/or programs (e.g., Surface Evolver) may be located in storage devices 616, which are in communication with processor unit 604 through communications framework 602. In these illustrative examples, the instructions are in a functional form on persistent storage 608. These instructions may be loaded into memory 606 for execution by processor unit 604. The processes of the different embodiments may be performed by processor unit 604 using computer-implemented instructions, which may be located in a memory, such as memory 606.

These instructions are referred to as program instructions, program code, computer usable program code, or computer-readable program code that may be read and executed by a processor in processor unit 604. The program code in the different embodiments may be embodied on different physical or computer-readable storage media, such as memory 606 or persistent storage 608.

Program code 618 is located in a functional form on computer-readable media 620 that is selectively removable and may be loaded onto or transferred to data processing system 600 for execution by processor unit 604. Program code 618 and computer-readable media 620 form computer program product 622 in these examples. In one example, computer-readable media 620 may be computer-readable storage media 624 or computer-readable signal media 626.

Computer-readable storage media 624 may include, for example, an optical or magnetic disk that is inserted or placed into a drive or other device that is part of persistent storage 608 for transfer onto a storage device, such as a hard drive, that is part of persistent storage 608. Computer-readable storage media 624 also may take the form of a persistent storage, such as a hard drive, a thumb drive, or a flash memory, that is connected to data processing system 600. In some instances, computer-readable storage media 624 may not be removable from data processing system 600.

In these examples, computer-readable storage media 624 is a physical or tangible storage device used to store program code 618 rather than a medium that propagates or transmits program code 618. Computer-readable storage media 624 is also referred to as a computer-readable tangible storage device or a computer-readable physical storage device. In other words, computer-readable storage media 624 is a media that can be touched by a person.

Alternatively, program code 618 may be transferred to data processing system 600 using computer-readable signal media 626. Computer-readable signal media 626 may be, for example, a propagated data signal containing program code 618. For example, computer-readable signal media 626 may be an electromagnetic signal, an optical signal, and/or any other suitable type of signal. These signals may be transmitted over communications links, such as wireless communications links, optical fiber cable, coaxial cable, a wire, and/or any other suitable type of communications link. In other words, the communications link and/or the connection may be physical or wireless in the illustrative examples.

In some illustrative embodiments, program code 618 may be downloaded over a network to persistent storage 608 from another device or data processing system through computer-readable signal media 626 for use within data processing system 600. For instance, program code stored in a computer-readable storage medium in a server data processing system may be downloaded over a network from the server to data processing system 600. The data processing system providing program code 618 may be a server computer, a client computer, or some other device capable of storing and transmitting program code 618.

The different components illustrated for data processing system 600 are not meant to provide architectural limitations to the manner in which different embodiments may be implemented. The different illustrative embodiments may be implemented in a data processing system including components in addition to and/or in place of those illustrated for data processing system 600. Other components shown in FIG. 16 can be varied from the illustrative examples shown. The different embodiments may be implemented using any hardware device or system capable of running program code. As one example, data processing system 600 may include organic components integrated with inorganic components and/or may be comprised entirely of organic components excluding a human being. For example, a storage device may be comprised of an organic semiconductor.

In another illustrative example, processor unit 604 may take the form of a hardware unit that has circuits that are manufactured or configured for a particular use. This type of hardware may perform operations without needing program code to be loaded into a memory from a storage device to be configured to perform the operations.

For example, when processor unit 604 takes the form of a hardware unit, processor unit 604 may be a circuit system, an application specific integrated circuit (ASIC), a programmable logic device, or some other suitable type of hardware configured to perform a number of operations. With a programmable logic device, the device is configured to perform the number of operations. The device may be reconfigured at a later time or may be permanently configured to perform the number of operations. Examples of programmable logic devices include, for example, a programmable logic array, a field programmable logic array, a field programmable gate array, and other suitable hardware devices. With this type of implementation, program code 618 may be omitted, because the processes for the different embodiments are implemented in a hardware unit.

In still another illustrative example, processor unit 604 may be implemented using a combination of processors found in computers and hardware units. Processor unit 604 may have a number of hardware units and a number of processors that are configured to run program code 618. With this depicted example, some of the processes may be implemented in the number of hardware units, while other processes may be implemented in the number of processors.

In another example, a bus system may be used to implement communications framework 602 and may be comprised of one or more buses, such as a system bus or an input/output bus. Of course, the bus system may be implemented using any suitable type of architecture that provides for a transfer of data between different components or devices attached to the bus system.

Additionally, communications unit 610 may include a number of devices that transmit data, receive data, or both transmit and receive data. Communications unit 610 may be, for example, a modem or a network adapter, two network adapters, or some combination thereof. Further, a memory may be, for example, memory 606, or a cache, such as that found in an interface and memory controller hub that may be present in communications framework 602.

Flowcharts and diagrams described herein illustrate the architecture, functionality, and operation of possible implementations of systems, methods, and computer program products according to various illustrative embodiments. In this regard, each block in a flowchart or block diagram may represent a module, segment, or portion of code, which comprises one or more executable instructions for implementing the specified logical function or functions. It should also be noted that, in some alternative implementations, the functions noted in a block may occur out of the order noted in the drawings. For example, the functions of two blocks shown in succession may be executed substantially concurrently, or the functions of the blocks may sometimes be executed in the reverse order, depending upon the functionality involved.

Additional Examples and Illustrative Combinations

This section describes additional aspects and features of foam-topology security screens, and related methods, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. A security screen for a building window, the security screen comprising:

a screen portion including a plurality of coplanar first segments, each of the first segments having opposing ends and generally forming an arc of a respective circle, each end of each of the first segments terminating at a respective vertex, each vertex joining two or more of the first segments at 120-degree angles;

an outer frame portion extending continuously around a periphery of the screen portion, the frame portion and the screen portion generally defining a plane of the screen; and a plurality of second segments connecting the frame portion to the screen portion, each of the second segments having a first end connected directly to the frame at a 90-degree angle and a second end connected at a 120-degree angle to a respective two of the first segments at a vertex of the screen portion;

wherein the first segments, the second segments, and the frame circumscribe a plurality of irregularly-shaped openings through the screen portion, such that each of the openings is enclosed on all sides within the plane of the screen.

A1. The security screen of A0, wherein a largest of the openings through the screen portion has a first area, a smallest of the openings through the screen portion has a second area, and the ratio of the first area to the second area does not exceed approximately 2.0.

A2. The security screen of A0, wherein the first segments, the second segments, and the frame comprise a same metal.

A3. The security screen of A2, wherein the metal is steel.

A4. The security screen of A0, wherein the first segments, the second segments, and the frame comprise a single monolithic structure.

A5. The security screen of A0, the frame further comprising one or more mounting tabs extending from the frame.

A6. The security screen of A0, wherein corners formed at the vertices are radiused.

B0. A security screen comprising:

a screen portion defining a plane and including a plurality of coplanar arc segments joined at respective vertices, such that a respective three of the arc segments extend at 120-degree angles from each of the vertices; and a frame portion extending continuously around a periphery of the screen portion, the frame portion connected to the screen portion by a subset of the arc segments, each one of the subset of arc segments having a first end connected to a respective vertex and a second end directly connected to the frame portion at a 90-degree angle;

wherein the plurality of arc segments includes a plurality of arc lengths and corresponding radius lengths, such that the arc segments and the frame portion define a plurality of irregular openings through the screen, each opening being enclosed on all sides within the plane of the screen.

C0. A security screen comprising:

a generally planar screen having a plurality of irregular first openings generally conforming to a two-dimensional foam topology, such that each of the first openings is bounded on all sides within the plane of the screen by circular arcs of varying length and radius, ends of the circular arcs joining at 120-degree angles at a plurality of vertices; and a frame extending continuously around the screen and defining a plurality of irregular second openings on a periphery of the screen, the second openings generally conforming to the two-dimensional foam topology, such that each of the second openings is bounded by one or more of the circular arcs and the frame.

C1. The security screen of C0, wherein each of the circular arcs that intersects the frame forms a respective right angle with the frame.

C2. The security screen of C0, wherein the first and second openings collectively define a set of screen openings, and an area of a largest one of the screen openings is no more than twice as large as an area of a smallest one of the screen openings.

C3. The security screen of C0, wherein the largest one of the screen openings is no larger than approximately thirty square inches.

C4. The security screen of C0, wherein the largest one of the screen openings is no larger than approximately fifteen square inches.

C5. The security screen of C0, wherein the largest one of the screen openings is no larger than approximately four square inches.

D0. A method for manufacturing a security screen, the method comprising:

generating, using a computer processor, a substantially random seed pattern of Voronoi regions within a plane having a boundary;

simulating, using the computer processor, a two-dimensional closed-cell foam topology based on the seed pattern, such that borders between the Voronoi regions are modified to become circular arcs of varying length and radius, intersecting at 120-degree angles at a plurality of vertices to define a plurality of irregular cells;

generating, using the computer processor, a final version of the foam topology in which the circular-arc borders have a consistent width; and producing, based on the final version of the foam topology, a screen structure having a plurality of solid segments delineating a plurality of openings, the solid segments corresponding to the circular-arc borders of the modified foam topology and the openings corresponding to the irregular cells of the topology.

D1. The method of D0, wherein producing the screen structure comprises cutting the plurality of openings in a solid metal sheet.

D2. The method of D0, wherein producing the screen structure comprises welding the solid segments together.

D3. The method of D0, wherein producing the screen structure comprises three-dimensional printing of the solid segments in a pattern conforming to the modified version of the foam topology.

D4. The method of D0, wherein the screen further includes a continuous frame disposed at the boundary of the plane of the topology.

D5. The method of D4, wherein the boundary and the frame are rectangular.

D6. The method of D0, wherein simulating the foam topology further comprises modifying the borders between peripheral Voronoi regions to intersect the boundary of the plane at respective 90-degree angles.

D7. The method of D0, wherein simulating the foam topology further includes limiting a range of sizes of the irregular cells.

D8. The method of D7, wherein limiting the range of sizes includes setting a target ratio of an area of a largest one of the cells to an area of a smallest one of the cells.

D9. The method of D8, wherein the target ratio is 2.0.

D10. The method of D0, further comprising attaching the screen structure to a building.

Advantages, Features, Benefits

The different embodiments and examples of the security screens and related methods described herein provide several advantages over known solutions for protecting windows from breakage and preventing unwanted entry. For example, illustrative embodiments and examples described herein provide an unlimited number of screen pattern designs, based on random seed patterns and selected constraints. In some examples, each window of a building may have a different screen pattern, if desired, while still maintaining the consistent overall appearance of a foam topology.

Additionally, and among other benefits, illustrative embodiments and examples described herein facilitate the efficient use of materials, because the simulated foam topology minimizes arc lengths overall, consistent with naturally-occurring foams.

No known system or device can perform these functions, particularly in the field of window security. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the invention(s) includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A security screen comprising:

a screen portion including a plurality of coplanar first segments, each of the first segments having opposing ends and generally forming an arc of a respective circle, each of the ends of each of the first segments terminating at a respective vertex, each of the vertices joining two or more of the first segments at 120-degree angles;

a frame portion extending continuously around a periphery of the screen portion, the frame portion and the screen portion generally defining a plane of the screen; and a plurality of second segments connecting the frame portion to the screen portion, each of the second segments having a first end connected directly to the frame portion at a 90-degree angle and a second end connected at a 120-degree angle to two of the first segments at one of the vertices of the screen portion;

wherein the first segments, the second segments, and the frame portion circumscribe a plurality of irregularly-shaped openings through the screen portion, such that each of the openings is enclosed on all sides within the plane of the screen.

2. The security screen of claim 1, wherein a largest of the openings through the screen portion has a first area, a smallest of the openings through the screen portion has a second area, and the ratio of the first area to the second area does not exceed approximately 2.0.

3. The security screen of claim 1, wherein the first segments, the second segments, and the frame comprise a same metal.

4. The security screen of claim 3, wherein the metal is steel.

5. The security screen of claim 1, wherein the first segments, the second segments, and the frame comprise a single monolithic structure.

6. The security screen of claim 1, the frame further comprising one or more mounting tabs extending from the frame.

7. The security screen of claim 1, wherein corners formed at the vertices are radiused.

8. A security screen for a window of a building, the security screen comprising:

a generally planar screen having a plurality of irregular first openings generally conforming to a two-dimensional foam topology, such that each of the first openings is bounded on all sides within a plane of the screen by circular arcs of varying length and radius, ends of the circular arcs joining at 120-degree angles at a plurality of vertices; and a frame extending continuously around the screen and defining a plurality of irregular second openings on a periphery of the screen, the second openings generally conforming to the two-dimensional foam topology, such that each of the second openings is bounded by one or more of the circular arcs and the frame.

9. The security screen of claim 8, wherein each of the circular arcs that intersects the frame forms a respective right angle with the frame.

10. The security screen of claim 8, wherein the first and second openings collectively define a set of screen openings, and an area of a largest one of the screen openings is no more than twice as large as an area of a smallest one of the screen openings.

11. The security screen of claim 8, wherein the largest one of the screen openings is no larger than approximately thirty square inches.

12. A method for manufacturing a security screen for a window of a building, the method comprising:

generating, using a computer processor, a substantially random seed pattern of Voronoi regions within a plane having a boundary;

simulating, using the computer processor, a two-dimensional closed-cell foam topology based on the seed pattern, such that borders between the Voronoi regions are modified to become circular arcs of varying length and radius, intersecting at 120-degree angles at a plurality of vertices to define a plurality of irregular cells;

generating, using the computer processor, a final version of the foam topology in which the circular-arc borders have a consistent width; and producing, based on the final version of the foam topology, a screen structure having a plurality of solid segments delineating a plurality of openings, the solid segments corresponding to the circular-arc borders of the final version of the foam topology and the openings corresponding to the irregular cells of the topology.

13. The method of claim 12, wherein producing the screen structure comprises cutting the plurality of openings in a solid metal sheet.

14. The method of claim 12, wherein producing the screen structure comprises welding the solid segments together.

15. The method of claim 12, wherein producing the screen structure comprises three-dimensional printing of the solid segments in a pattern conforming to the final version of the foam topology.

16. The method of claim 12, wherein the screen structure further includes a continuous peripheral frame.

17. The method of claim 16, wherein the frame is rectangular.

18. The method of claim 12, wherein simulating the foam topology further comprises modifying the borders between peripheral Voronoi regions to intersect the boundary of the plane at respective 90-degree angles.

19. The method of claim 12, wherein simulating the foam topology further includes limiting a range of sizes of the irregular cells.

20. The method of claim 19, wherein limiting the range of sizes includes setting a target ratio of an area of a largest one of the cells to an area of a smallest one of the cells.

* * * * *